US011739775B2

(12) United States Patent
Li et al.

(10) Patent No.: US 11,739,775 B2
(45) Date of Patent: Aug. 29, 2023

(54) EXPANDING AND RADIATIVE FLOW MECHANISM

(71) Applicant: ZHEJIANG UNIVERSITY, Zhejiang (CN)

(72) Inventors: Xin Li, Zhejiang (CN); Xubo Yu, Zhejiang (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 17/448,672

(22) Filed: Sep. 23, 2021

(65) Prior Publication Data

US 2022/0325732 A1 Oct. 13, 2022

(30) Foreign Application Priority Data

Apr. 9, 2021 (CN) ..... 202110387919.0

(51) Int. Cl.
*F15D 1/02* (2006.01)
*F15D 1/04* (2006.01)

(52) U.S. Cl.
CPC ..... *F15D 1/04* (2013.01)

(58) Field of Classification Search
CPC ..... F15D 1/04
USPC ..... 138/39, 40
See application file for complete search history.

(56) References Cited

U.S. PATENT DOCUMENTS 2,262,807 A * 11/1941 Larner ..... G01F 1/22 138/40
3,894,236 A * 7/1975 Hazelrigg ..... C02F 1/325 250/435
3,964,875 A * 6/1976 Chang ..... F01N 3/2892 138/40
4,354,762 A * 10/1982 Cantoni ..... B01F 25/31 366/340
4,891,935 A * 1/1990 McLaurin ..... F23D 11/007 60/737
5,567,079 A * 10/1996 Felder ..... E02B 13/00 405/74
7,111,799 B2 * 9/2006 Batich ..... C23C 18/1616 138/40

* cited by examiner

*Primary Examiner* — James F Hook
(74) *Attorney, Agent, or Firm* — McCoy Russell LLP

(57) ABSTRACT

The present disclosure relates to an expanding and radiative flow mechanism. The mechanism has a bottom surface. The bottom surface is provided with a fluid supply port. The bottom surface of the mechanism and a surface of a to-be-adsorbed object form a gap during use. A fluid flows out from the fluid supply port, enters the gap and flows out along the gap. The gap is an expanding gap and meets the following: a radial length exists with the fluid supply port as an initial point of the flow, and a height of the gap continuously increases in an outward radial direction within this length. With improvements to a parallel radiative flow mechanism, the mechanism of the present disclosure can effectively increase an absorption force of a radiative flow, which is conducive to subsequent applications thereof.

9 Claims, 4 Drawing Sheets

EXPANDING AND RADIATIVE FLOW MECHANISM

CROSS REFERENCE TO RELATED APPLICATIONS

The present application claims priority to Chinese Patent Application No. 202110387919.0 filed on Apr. 9, 2021. The entire contents of the above-listed application is hereby incorporated by reference for all purposes.

TECHNICAL FIELD

The present disclosure belongs to the field of adsorption technologies, and is directed to an expansion radiation flowing mechanism.

BACKGROUND

A parallel radiative flow mechanism is a type of apparatus widely applied to automatic production lines, and has a non-contact adsorption function. FIG. 1 is a schematic diagram illustrating a parallel radiative flow mechanism. The parallel radiative flow mechanism has a bottom surface, which is a flat surface and provided with a fluid supply port. The bottom surface is placed above a to-be-adsorbed surface, and a parallel gap is formed in between. As shown by arrows in the figure, a high-pressure fluid flows out from the fluid supply port and enters the parallel gap. In the gap, the fluid flows from the fluid supply port to a periphery to form a parallel radiative flow.

A flow cross section of the parallel radiative flow gradually increases in a flow direction, i.e., a farther distance from the fluid supply port indicates a larger cross-sectional flow area. Due to mass conservation of fluids, a larger cross-sectional flow area indicates a smaller fluid velocity. That is, the flow from the fluid supply port to the periphery is a decelerated flow. According to a fluid motion equation (Navier-Strokes equation), an inertia effect $$\left(\rho u_r \frac{\partial u_r}{\partial r}\right.,$$

where $\mu_r$ is a radial velocity, r is a radial location, and $$\frac{\partial u_r}{\partial r}$$

is a radial velocity gradient) of the decelerated flow may form a positive pressure gradient $$\left(\frac{\partial P}{\partial r}\right.,$$

where P is a pressure), and the positive pressure gradient may form an inside-low outside-high pressure distribution in the parallel gap, as shown in FIG. 2. This means that a pressure in the gap is lower than a peripheral ambient pressure, and therefore the parallel radiative flow mechanism can apply an absorption force to the to-be-adsorbed surface.

SUMMARY

To overcome the defects in the prior art, the present disclosure provides an expanding and radiative flow mechanism. With improvements to a parallel radiative flow mechanism, this mechanism can further effectively increase an absorption force of this mechanism, which is conducive to subsequent applications thereof.

The technical solution adopted by the present disclosure is as follows.

Disclosed is an expanding and radiative flow mechanism. The mechanism has a bottom surface. The bottom surface is provided with a fluid supply port. The bottom surface of the mechanism and a surface of a to-be-adsorbed object form a gap during use. A fluid flows out from the fluid supply port, enters the gap and flows out along the gap. The gap is an expanding gap and meets the following: a radial length exists with the fluid supply port (i.e., a fluid inlet of the expanding gap) as an initial point, and a height of the gap continuously increases in an outward radial direction within this length.

In the solution described above, further, the surface of the to-be-adsorbed object may be a flat surface; or the bottom surface of the mechanism may be a flat surface.

Further, the height of the gap may linearly or nonlinearly increase in the outward radial direction within the radial length; and still further, the height of the gap may keep unchanged in the outward radial direction beyond the radial length.

Further, the gap may meet the following: the height of the gap continuously and linearly increases in the outward radial direction with the fluid supply port as the initial point.

Further, the radial length should meet the following: the radial length is 10 or more times a height of the gap at the fluid inlet of the expanding gap, and therefore a negative pressure and an absorption force can be more sufficiently and effectively increased.

The present disclosure increases the absorption force by changing a flow form of the fluid. FIG. 3 is a schematic diagram illustrating a structure principle of the present disclosure. Compared with a parallel radiative flow mechanism in FIG. 1, the expanding gap is formed between the bottom surface of the expanding and radiative flow mechanism of the present disclosure and the surface of the to-be-adsorbed object, i.e., a height of a flow cross section of the fluid increases in a flow direction of the fluid at least at an initial stage of the expanding gap. The fluid flows from the fluid supply port to a periphery to form an expanding and radiative flow. It was found through both theoretical analysis and experimental tests that, an absorption force generated by such an expanding and radiative flow mechanism is significantly greater than that of a parallel radiative flow mechanism.

BRIEF DESCRIPTION OF THE FIGURES

FIG. 10A is a small-radius region, and FIG. 10B is a large-radius region.

DESCRIPTION OF EMBODIMENTS

The following further describes the solution of the present disclosure with reference to the embodiments and the accompanying drawings.

The present disclosure provides an expanding and radiative flow mechanism by making improvements to a parallel radiative flow mechanism, to be specific, by changing a flow form of a fluid to increase an absorption force. The mechanism has a bottom surface. The bottom surface is provided with a fluid supply port. The bottom surface of the mechanism and a surface of a to-be-adsorbed object form a gap during use. A fluid flows out from the fluid supply port, enters the gap and flows out along the gap. The gap is an expanding gap and meets the following: a radial length exists with the fluid supply port as an initial point, and a height of the gap continuously increases in an outward radial direction within this length.

The following provides a description by using the embodiments.

Embodiment 1

Figure 1:
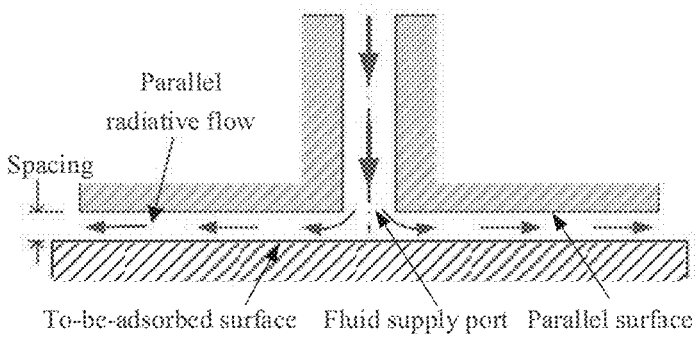
FIG. 1 is a schematic diagram illustrating a parallel radiative flow mechanism.
Figure 2:
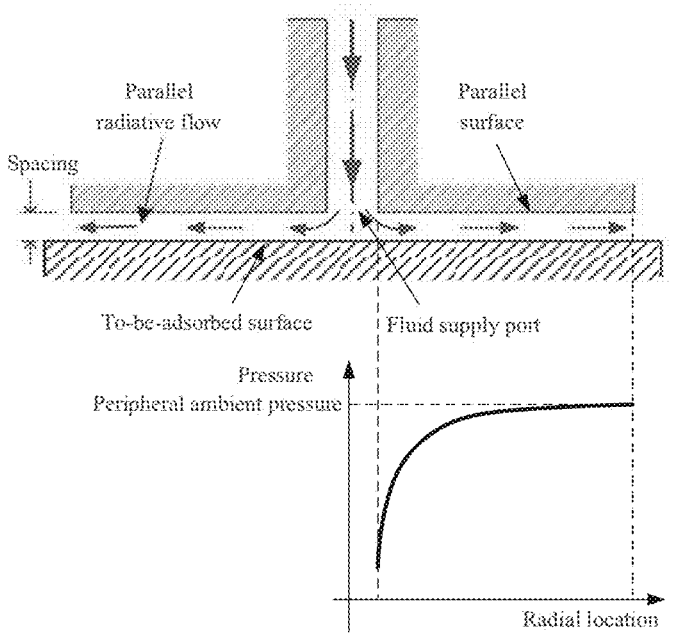
FIG. 2 is a changing curve of a pressure in a gap of a parallel radiative flow mechanism along with a radial position.
Figure 3:
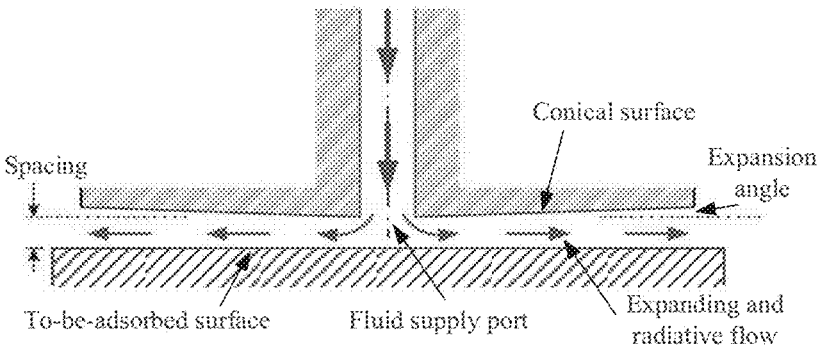
FIG. 3 is a schematic diagram illustrating a mechanism according to the present disclosure.

As shown in FIG. 3, in this embodiment, the bottom surface of the mechanism is a conical surface, the surface of the to-be-adsorbed object is a flat surface, and the expanding gap is formed between the conical surface and the to-be-adsorbed surface, i.e., a height of a flow cross section of the fluid continuously and linearly increases in a flowing direction of the fluid.

The fluid flows from the fluid supply port to a periphery to form an expanding and radiative flow. It was found through experimental tests that, an absorption force of the expanding and radiative flow mechanism is significantly greater than that of the parallel radiative flow mechanism. For example, under the conditions that the fluid is air, a flow rate is 26 g/min, a spacing (i.e., a height of the expanding gap at a fluid inlet) is 0.35 mm, a diameter of a parallel surface (assuming that a flat surface of the bottom surface opposite to the to-be-adsorbed surface is circular) is 50 mm, a diameter of the fluid supply port is 4 mm, and an expansion angle of the conical surface is 0.025 rad, the expanding and radiative flow mechanism can generate an absorption force of 0.1 N, while the parallel radiative flow mechanism can generate an absorption force less than 0.05 N under the same conditions.

Figure 4:
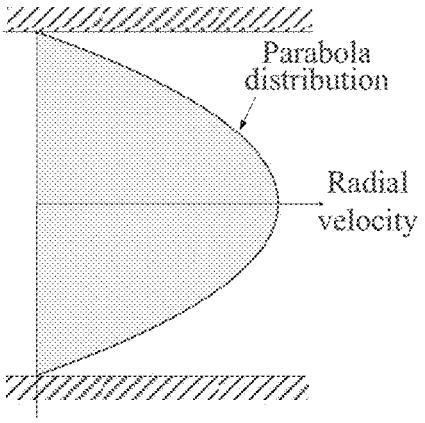
FIG. 4 shows a fluid velocity distribution of a parallel radiative flow mechanism.
Figure 5:
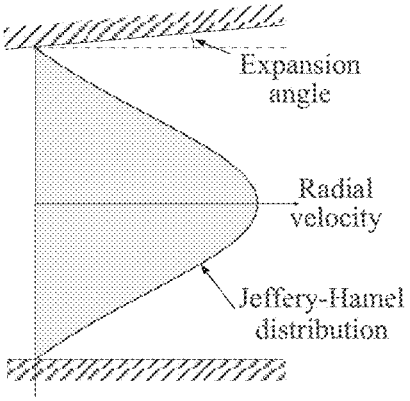
FIG. 5 shows a fluid velocity distribution in a mechanism according to the present disclosure.

According to research, the expanding and radiative flow mechanism can greatly increase an absorption force mainly because a radial velocity distribution of the expanding and radiative flow is changed. While a radial velocity distribution of the parallel radiative flow approaches a parabola (as shown in FIG. 4), the radial velocity distribution of the expanding and radiative flow is close to a shape shown in FIG. 5. A mathematical expression of this shape was put forward by Jeffery-Hamel, and therefore it is also known as a Jeffery-Hamel velocity distribution. The radial velocity distribution determines a velocity gradient $$\left(\frac{\partial u_r}{\partial r}\right),$$

and the velocity gradient determines a magnitude of an inertia effect $$\left(\rho u_r \frac{\partial u_r}{\partial r}\right)$$

of the decelerated flow. Theoretical calculation proves that the inertia effect of the Jeffery-Hamel velocity distribution is greater than that of the parabola velocity distribution and can generate a larger pressure gradient $$\left(\frac{\partial P}{\partial r}\right).$$

Figure 6:
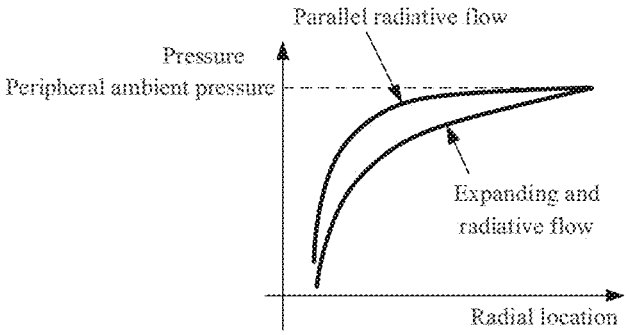
FIG. 6 is a comparison of changing curves of a pressure in a gap of a parallel radiative flow mechanism and a pressure in a gap of a mechanism according to the present disclosure along with a radial position.

FIG. 6 shows a comparison of pressure distributions of these two mechanisms.

It can be seen that the expanding and radiative flow mechanism can form a lower pressure distribution and accordingly a higher absorption force.

Embodiment 2

The effect of the expanding and radiative flow may be improved by increasing an expansion degree of the radiative flow.

Figure 7:
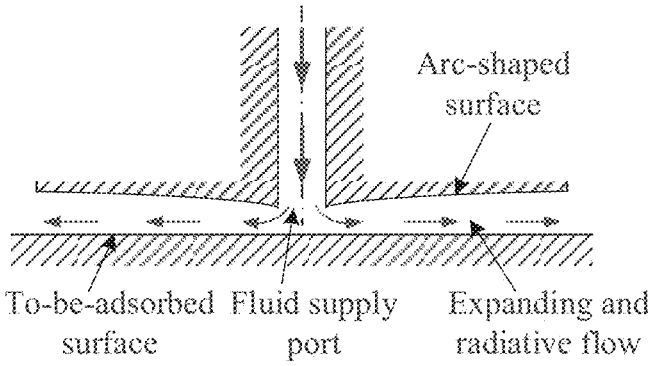
FIG. 7 is a schematic structural diagram illustrating another specific implementation of a mechanism according to the present disclosure.

In this embodiment, as shown in FIG. 7, the surface of the to-be-adsorbed object is a flat surface, while the bottom surface of the expanding and radiative flow mechanism of the present disclosure is an arc-shaped surface. Compared with the conical surface, the arc-shaped surface more rapidly expands the fluid to generate a larger velocity gradient $$\left(\frac{\partial u_r}{\partial r}\right)$$

after the fluid enters the expanding gap from the fluid supply port. Therefore, the arc-shaped surface can enhance the inertia effect of the flow and lead to a lower pressure and a higher absorption force.

Embodiment 3

In the present disclosure, a shape of the bottom surface of the mechanism in the present disclosure may be designed based on a shape of the surface of the to-be-adsorbed object, provided that an expanding gap may be formed in between. That is, an absorption force can be increased as long as the height of the flow cross section of the fluid increases in the flow direction of the fluid within a certain radial length with the fluid inlet of the expanding gap as the initial point of the flow.

Figure 8:
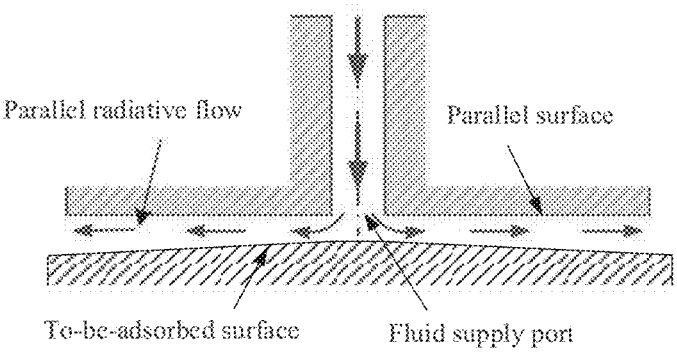
FIG. 8 is a schematic structural diagram illustrating still another specific implementation of a mechanism according to the present disclosure.

In this embodiment, as shown in FIG. 8, the bottom surface of the expanding and radiative flow mechanism is a flat surface, the surface of the to-be-adsorbed object is a conical surface, an expanding gap is formed in between, and the fluid flows to the periphery through the gap between the two surfaces after flowing out from the fluid supply port. The height of the flow cross section of the fluid continuously increases in the flow direction of the fluid to form the expanding and radiative flow, and therefore a negative pressure and an absorption force can be increased as well.

Embodiment 4

Figure 9:
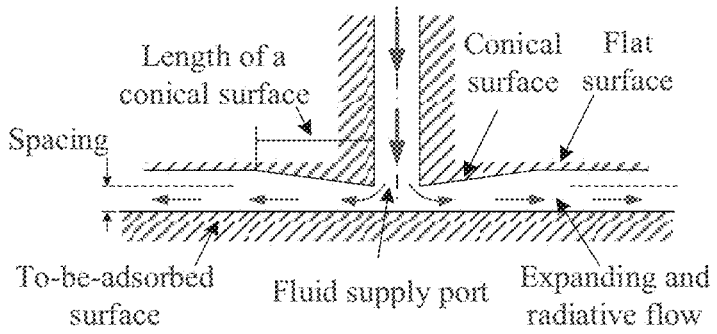
FIG. 9 is a schematic structural diagram illustrating yet another specific implementation of a mechanism according to the present disclosure.

This embodiment is shown by a structure in FIG. 9. An inner side of the bottom surface of the expanding and radiative flow mechanism is a conical surface, and an outer side thereof is a flat surface. In a small-radius region on the inner side, an expanding and radiative flow is formed between the conical surface and the to-be-adsorbed surface, and therefore a negative pressure and an absorption force can be increased.

Figures 10A, 10B:
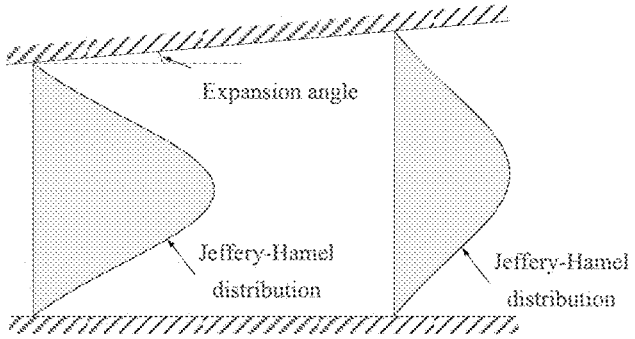
FIGS. 10A and 10B are diagrams illustrating a relationship between a flow velocity distribution and a radius area of an expanding and radiative flow, where

According to further research, an enhancement brought by the expanding and radiative flow to the inertia effect thereof is more obvious in the small-radius region and becomes weaker in a large-radius region. Because a cross-sectional flow area of the fluid is small in the small-radius region (FIG. 10A), a radial velocity is high. Therefore, an obvious Jeffery-Hamel flow velocity distribution can be formed, and accordingly a larger velocity gradient and a corresponding inertia effect can be generated. Because a cross-sectional flow area of the fluid increases in the large-radius region (FIG. 10B), the radial velocity decreases. Therefore, an enhancement to the inertia effect of the Jeffery-Hamel flow velocity distribution is weakened, and accordingly the velocity gradient and the corresponding inertia effect cannot be significantly increased.

Figure 11:
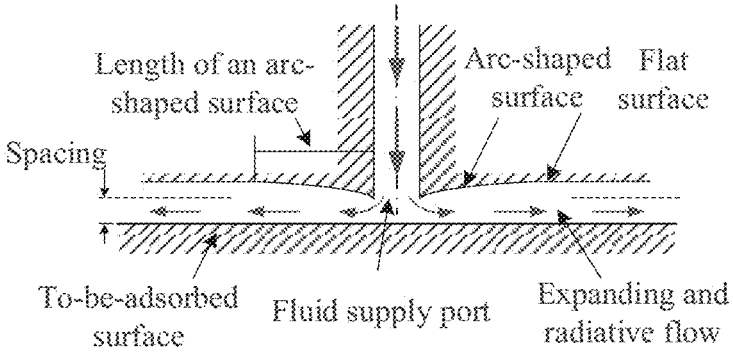
FIG. 11 is a schematic structural diagram illustrating a further another specific implementation of a mechanism according to the present disclosure.

In addition, a length of the expanding gap is an important design parameter. If the length of the expanding gap is excessively small, the inertia effect of the expanding and radiative flow in the small-radius region cannot be sufficiently utilized to increase the negative pressure. It was found through theoretical and experimental research that, if the length of the expanding gap is 10 or more times the height of the gap at the fluid inlet, the inertia effect of the expanding and radiative flow can be sufficiently utilized to increase the negative pressure and the absorption force. The conical surface in this embodiment may be replaced with an arc-shaped surface, as shown in FIG. 11.

The invention claimed is:

1. An expanding and radiative flow mechanism, wherein the mechanism has a bottom surface positioned opposite a to-be-adsorbed surface, the bottom surface is provided with a fluid supply port, the bottom surface of the mechanism and the to-be-adsorbed surface form a gap during use, a fluid flows out from the fluid supply port, enters the gap and flows out along the gap, and the gap is an expanding gap and meets the following: a radial length exists with the fluid supply port as an initial point in the flow, and a height of the gap continuously increases in an outward radial direction within the radial length, wherein the flow mechanism is expanding in that the height of the gap between the bottom surface and the to-be-adsorbed surface is increasing along the radial length extending radially from the fluid supply port, wherein the flow mechanism is radiative in that the fluid flows radially outward from the initial point in the flow of the fluid from the fluid supply port, and wherein the bottom surface extends radially outward from the fluid supply port along a gap length that is greater than or equal to the radial length and greater than an opening diameter of the fluid supply port in the bottom surface.

2. The expanding and radiative flow mechanism according to claim 1, wherein the to-be-adsorbed surface is a flat surface.

3. The expanding and radiative flow mechanism according to claim 1, wherein the bottom surface of the mechanism is a flat surface.

4. The expanding and radiative flow mechanism according to claim 1, wherein the height of the gap linearly increases in the outward radial direction within the radial length.

5. The expanding and radiative flow mechanism according to claim 4, wherein the height of the gap keeps unchanged in the outward radial direction beyond the radial length.

6. The expanding and radiative flow mechanism according to claim 1, wherein the height of the gap nonlinearly increases in the outward radial direction within the radial length.

7. The expanding and radiative flow mechanism according to claim 6, wherein the height of the gap keeps unchanged in the outward radial direction beyond the radial length.

8. The expanding and radiative flow mechanism according to claim 1, wherein the gap meets the following: the height of the gap continuously and linearly increases in the outward radial direction with the fluid supply port as the initial point of the flow.

9. The expanding and radiative flow mechanism according to any one of claim 1, wherein the radial length is 10 or more times a height of the gap at a fluid inlet of the expanding gap.

* * * * *